US005547014A

United States Patent [19]

Brückner et al.

[11] Patent Number: 5,547,014

[45] Date of Patent: Aug. 20, 1996

[54] ASSEMBLY OF MOLD AND IMMERSION NOZZLE WITH IMPROVED DISCHARGE CHANNEL

[75] Inventors: Raimund Brückner, Niedernhausen; José Gimpera, Wiesbaden, both of Germany

[73] Assignee: Didier-Werke AG, Wiesbaden, Germany

[21] Appl. No.: 251,200

[22] Filed: May 31, 1994

[30] Foreign Application Priority Data

Jun. 17, 1993 [DE] Germany ..... 43 19 966.6

[51] Int. Cl.[6] ..... B22D 11/04; B22D 11/10; B22D 41/50

[52] U.S. Cl. ..... 164/437; 222/594; 222/599

[58] Field of Search ..... 164/437, 337; 222/606, 607, 594, 597, 598, 599

[56] References Cited

U.S. PATENT DOCUMENTS

| | | | |
|---|---|---|---|
| 3,310,850 | 3/1967 | Armburster | 164/437 X |
| 4,865,115 | 9/1989 | Hirata et al. | 164/437 X |
| 5,238,050 | 8/1993 | Folder et al. | 164/437 X |
| 5,345,994 | 9/1994 | Kato et al. | 164/437 X |

FOREIGN PATENT DOCUMENTS

| | | | |
|---|---|---|---|
| 3811751 | 10/1989 | Germany . | |
| 3839214 | 5/1990 | Germany . | |
| 3907003 | 9/1990 | Germany . | |
| 3918228 | 12/1990 | Germany . | |
| 3805071 | 7/1991 | Germany . | |
| 3809071 | 7/1991 | Germany . | |
| 4032624 | 4/1992 | Germany . | |
| 4104690 | 8/1992 | Germany . | |
| 4132910 | 11/1992 | Germany . | |
| 4142477 | 12/1992 | Germany . | |
| 52-25811 | 7/1977 | Japan | 164/437 |
| 55-136550 | 10/1980 | Japan | 164/437 |
| 61-165257 | 7/1986 | Japan | 164/437 |
| 2-258145 | 10/1990 | Japan | 164/437 |
| 1227321 | 4/1986 | U.S.S.R. | 164/437 |

*Primary Examiner*—J. Reed Batten, Jr.
*Attorney, Agent, or Firm*—Wenderoth, Lind & Ponack

[57] ABSTRACT

An immersion nozzle includes an immersion zone inserted into a long-thin mold cavity of a mold. A discharge channel extends through the nozzle for discharging molten metal into the mold cavity. The discharge channel includes an inlet region, an outlet region including a portion passing through the immersion zone, and a pool-forming chamber between the inlet region and the outlet region at a location adjacent the immersion zone. The portion of the outlet region of the discharge channel that extends through the immersion zone is widened and has a configuration to approximate the cross-sectional configuration of the mold cavity. The outlet region has, extending from the chamber in a direction of material flow, a configure approximately corresponding to the configuration of the portion of the outlet region through the immersion zone.

46 Claims, 3 Drawing Sheets

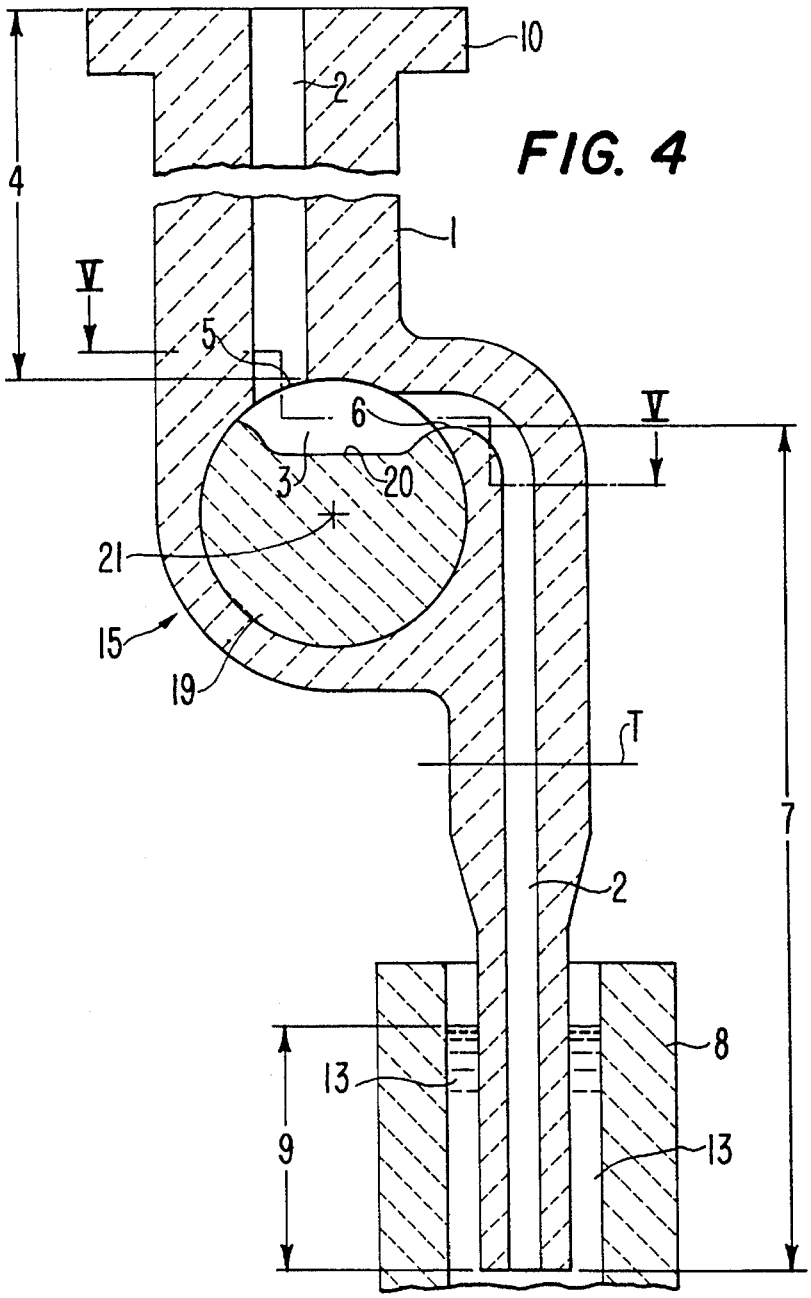
FIG. 4
FIG. 5
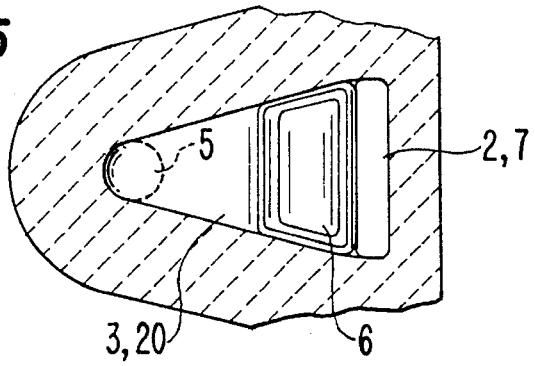

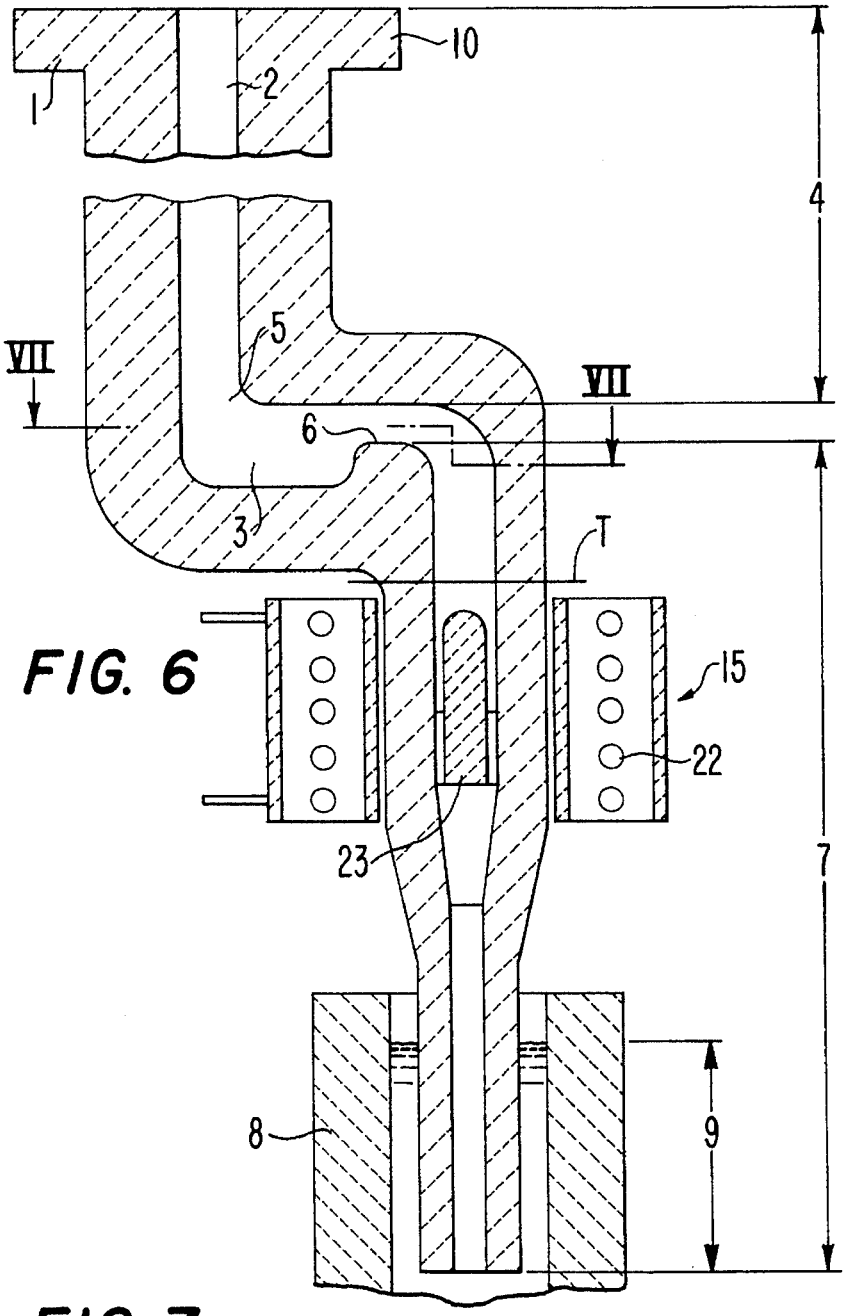
FIG. 6
FIG. 7
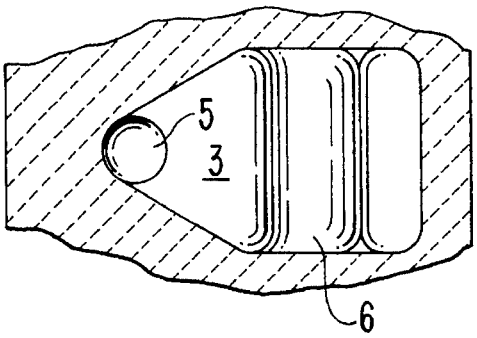

ASSEMBLY OF MOLD AND IMMERSION NOZZLE WITH IMPROVED DISCHARGE CHANNEL

BACKGROUND OF THE INVENTION

The present invention relates to a submerged or immersion nozzle for casting material, particularly molten metal, further particularly molten steel, into a mold cavity within a mold, particularly a long thin such cavity in a slab mold, wherein a discharge channel through the nozzle has a widened portion in an immersion zone of the nozzle to be immersed within material in the mold. The present invention further is directed to an assembly of such nozzle with a mold having a mold cavity of long, thin transverse cross-sectional configuration.

An immersion nozzle of the above general type is disclosed in DE 41 42 447 A1. Therein, a discharge channel through the nozzle is widened or expanded in the immersion zone of the nozzle. Such discharge channel does not however extend to the vicinity of the narrow sides or portions of the mold. The nozzle has two outflow openings that are separated by a wedge-shaped bottom piece. The melt flows unchecked through such outflow openings, subject to the effect of ferrostatic pressure, only into a central region of the mold cavity. The molten metal has to distribute itself throughout the mold cavity, i.e. the molten metal has to flow substantial distances after discharge from the outflow openings. Such an arrangement can lead to turbulence, and such turbulence is undesirable since it can have a negative effect on the quality of a produced slab or steel strip.

DE 40 32 624 A1 discloses an immersion nozzle wherein two single currents of molten metal are produced that are guided against one another in front of an outflow opening from the nozzle. This is said to achieve a uniform, stable distribution of the molten metal within the mold cavity. However, the melt emerges from the outflow opening subject to the effect of ferrostatic pressure that also is defined by the length of the immersion nozzle. From such opening the melt has to distribute itself throughout the mold cavity.

Immersion nozzles with outflow openings directed toward the side or outwardly are disclosed in DE 38 11 751 A1, DE 38 39 214 A1, DE 39 07 003 A1, DE 39 18 228 A1 and DE 41 04 690 A1.

DE 41 32 910 C1 discloses an electromagnetic flow regulating device to control and regulate the flow of molten metal. Within an induction coil of the device is a space provided between an inlet channel and an outlet channel. Within such space a casting stream of molten metal is supposed to be constricted by radial forces of a magnetic field of the induction coil.

In DE 38 05 071 C1 is disclosed a closure of a metallurgical vessel, such closure having an elongated outflow opening for a continuous casting mold.

In DE 38 09 071 C2 is disclosed a rotary slide gate nozzle for an elongated nozzle of a metallurgical vessel. A pipe-like attachment can form an immersion nozzle.

SUMMARY OF THE INVENTION

It is an object of the present invention to provide an improved immersion nozzle of the above described general type but wherein it is possible to overcome the above and other prior art disadvantages.

It is a further object of the present invention to provide such an immersion nozzle that is constructed in such a manner that the molten metal is subjected to as little turbulence as possible when it enters the mold and that is uniformly distributed over the cross section of the mold cavity.

It is a still further object of the present invention to provide an improved assembly of such immersion nozzle in combination with a mold having therein a mold cavity having a long, thin transverse cross-sectional configuration.

The above objects are achieved in accordance with the present invention by the provision of an improved configuration of the discharge channel through the immersion nozzle. Particularly, the discharge channel includes, between the inlet region and the outlet region and at a location in the vicinity of the immersion zone of the nozzle, a pool-forming chamber. A portion of the outlet region of the discharge channel that extends through the immersion zone of the nozzle is widened and has a channel geometry or configuration that approximates the internal cross-sectional configuration of the mold cavity of the mold. The discharge channel has approximately the same channel geometry or configuration in the outlet region, in the direction of flow from the pool-forming chamber, as in the portion of the discharge channel that extends through the immersion zone of the nozzle.

The molten metal flows through the inlet region of the discharge channel into the chamber. The molten metal is collected in the pool-forming chamber and is distributed therein. The molten metal flows from the chamber over an overflow rim or weir into the outlet region of the discharge channel. By collecting in the chamber, the ferrostatic pressure of the molten metal within the outlet region is reduced. For this flow pressure building up in the outlet region to remain small, the pool-forming chamber is disposed adjacent or in the vicinity of the immersion zone of the nozzle. In other words, the chamber is located much closer to the immersion zone of the nozzle than to an upper or inlet end of the nozzle.

Since the discharge channel in the outlet region thereof has approximately the same cross-sectional geometry or configuration as the transverse cross-sectional configuration of the mold cavity, the molten metal does not swirl in the outlet region and when discharged therefrom and entering the mold cavity. The molten metal enters the mold cavity virtually uniformly distributed over the entire cross section thereof. The molten metal is required to flow only a very short distance within the mold cavity to the sides thereof. All together, the molten metal enters virtually without turbulence and uniformly into the mold cavity. Hardly any turbulence is produced within the mold cavity. The mold can be a thin slab mold or a strip casting mold.

BRIEF DESCRIPTION OF THE DRAWINGS

Other objects, features and advantages of the present invention will be apparent from the following detailed description of preferred embodiments thereof, with reference to the accompanying drawings, wherein:

FIG. 4 is a view similar to FIG. 1, but of another embodiment of the present invention;

FIG. 5 is sectional view along line V—V of FIG. 4;

FIG. 6 is a view similar to FIGS. 1 and 4, but of another embodiment of the present invention; and FIG. 7 is a sectional view along line VII—VII of FIG. 6.

DETAILED DESCRIPTION OF THE INVENTION

Figure 1:
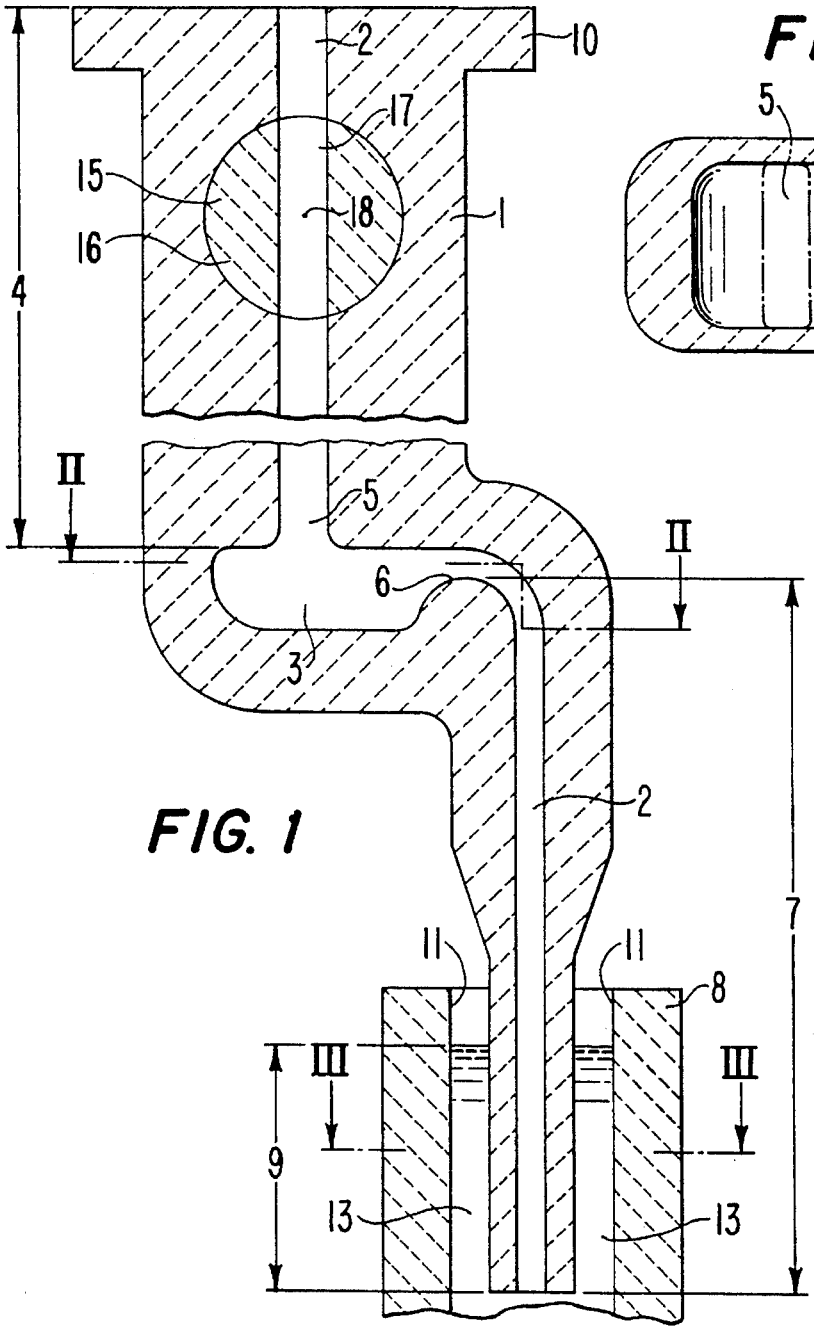
FIG. 1 is a longitudinal cross-sectional view of a first embodiment of the present invention.

A submerged or immersion nozzle 1 has therethrough a discharge channel 2 for discharging material into a mold cavity of a mold 8. As illustrated, immersion nozzle 1 is formed of suitable refractory ceramic material for the casting of molten metal. Discharge channel 2 includes an inlet region 4 and an outlet region 7. Discharge channel 2 further includes, between inlet region 4 and outlet region 7, a pool-forming chamber 3. Chamber 3 lies below inlet region 4 that opens into chamber 3 from above through mouth 5.

An overflow rim or weir 6 is formed on one side of chamber 3. Chamber 3 opens over rim 6 into outlet region 7 of channel 2. Rim 6 is rounded to achieve a smooth stream or flow of molten metal thereover.

Immersion zone 9 of nozzle 1 is inserted into the mold cavity within mold 8. A portion of outlet region 7 of channel 2 extends through immersion zone 9 and projects into the mold cavity.

Outlet region 7 is significantly shorter than inlet region 4. Pool-forming chamber 3 is located at a position significantly closer to immersion zone 9 than to an upper end 10 of nozzle 1 that can be attached to a metallurgical vessel.

Figure 3:
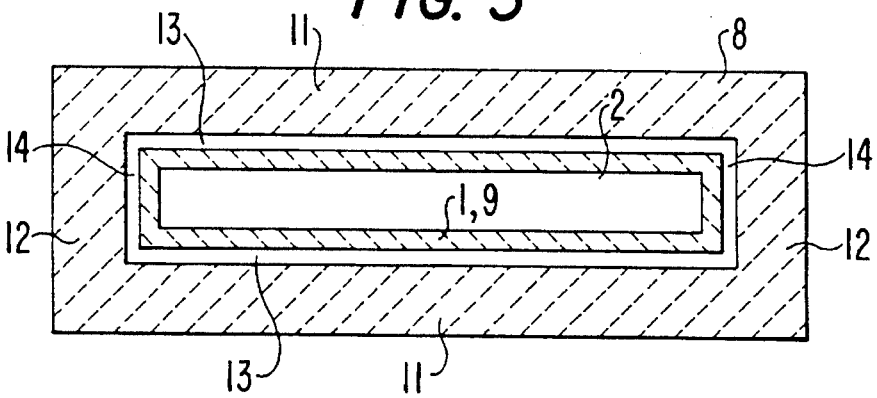
FIG. 3 is a sectional view along line III—III of FIG. 1.

Mold 8 has long walls 11 and narrow walls 12 that define the mold cavity and that provide the long, thin transverse cross-sectional configuration thereof. In the case of a thin slab mold, narrow or short walls 12 are significantly shorter than long walls 11, as shown in FIG. 3. Within the immersion zone 9 of nozzle 1 the discharge channel 2, and specifically a portion of outlet region 7 thereof, has a channel geometry or transverse cross-sectional configuration that approaches or approximates the inside cross section of the mold cavity of mold 8. Thus, the immersion zone 9 has a cross section that is approximately proportional to the internal cross section of the mold 8, and indeed is approximately equal thereto except for the wall thickness of immersion zone 9 and for long and short gaps 13, 14 that are necessary but of minimal dimension.

Above immersion zone 9 the outlet region 7 of discharge channel 2 has approximately the same cross-sectional geometry or configuration as in the immersion zone 9. In the embodiments of FIGS. 1 and 4, the cross section of outlet region 7 above immersion zone 9 is the same as the cross section thereof through immersion zone 9, i.e. the cross section of outlet region 7 is uniform throughout. In the embodiment of FIG. 6, the outlet region 7 narrows above immersion zone 9 into narrow portions.

Figure 2:
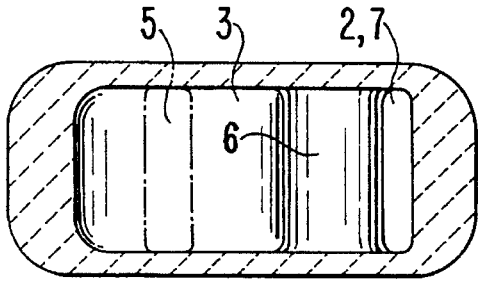
FIG. 2 is a sectional view along line II—II of FIG. 1.

The cross-sectional geometry or configuration of the discharge channel 2 in the inlet region 4 thereof can be designed independently of the cross-sectional geometry or configuration of the outlet region 7 thereof and the portion thereof extending through the immersion zone 9. In the embodiment of FIGS. 1 and 2, and as particularly shown in FIG. 2, the cross-sectional configuration of inlet region 4 is similar to that of outlet region 7. Thus, the discharge channel 2 in inlet region 4 also is narrow and elongated. In the embodiments of FIGS. 4–7, in contrast, the cross section of the inlet region 4 of discharge channel 2 is circular, as shown particularly in FIGS. 5 and 7. It is to be understood however that the inlet region 4 of the embodiments of FIGS. 4–7 could be designed to have the same or similar configuration as shown in the embodiment of FIGS. 1 and 2. Similarly, the inlet region 4 of the embodiment of FIGS. 1 and 2 could be designed to have the same or similar configuration as that of the embodiments of FIGS.s 4–7. The cross-sectional area of the inlet region 4 of the discharge channel 2 is approximately as large as the cross-sectional area of the portion of the discharge channel 2 that extends through the immersion zone 9.

In accordance with an additional feature of the present invention, there is provided a closing and/or regulating device 15 by which the flow of melt through the nozzle can be controlled, i.e. regulated and closed. Device 15 is integrated into the structure of the nozzle 1. In the embodiment of FIG. 1, the device 15 is disposed in the inlet region 4. In the embodiment of FIG. 4, the device 15 is provided in chamber 3. In the embodiment of FIG. 6, the device 15 is provided in the outlet region 7.

The embodiment of FIG. 1 provides the device 15 in the form of a roller-shaped rotor 16 mounted in nozzle 1. Rotor 16 has extending therethrough a radial slot 17. Slot 17 has a configuration corresponding to the configuration of inlet region 4. In the open position of FIG. 1, slot 17 forms a continuation of inlet region 4, and the flow of molten metal is unimpeded. If rotor 16 is rotated around axis 18, the flow of melt may be more or less interrupted, and indeed can be completely stopped.

In the embodiment of FIG. 4, device 15 is disposed at the location of chamber 3 and includes a rotor 19 having formed in a peripheral surface thereof a recess 20 that defines a flattening forming the floor of chamber 3. With this arrangement wherein the recess 20 forms chamber 3, chamber 3 is open in the direction of inlet region 4 and in the direction of outlet region 7, when the rotor 19 is in the open position shown in FIG. 4. By rotating rotor 19 around axis 21 the flow of melt can be totally or partially interrupted. In so doing, a part of the outer periphery of rotor 19 is moved in front of mouth 5 of inlet region 4 and/or the outlet region 7 above overflow rim 6.

In the embodiment of FIG. 6, device 15 is formed by an electromagnetic flow regulator 22, 23 having an induction coil that envelopes nozzle 1 in an area thereof of outlet region 7. When an induction current flows through the coil, the result will be an effect on the molten metal such that the ferrostatic pressure thereof is reduced. Device 15 according to this embodiment also could be disposed in the region of chamber 3.

The above described nozzle 1 functions essentially in the following manner. Thus, during a casting operation, material such as molten metal flows through inlet region 4 into pool-forming chamber 3. Within chamber 3 the molten metal is killed or stilled and is distributed within chamber 3 as a pool of molten metal. Molten metal then flows over overflow rim 6 and is discharged into outlet region 7. In so doing, the molten metal leaves chamber 3 already in a current or flow width that corresponds essentially to the long dimension of the mold cavity within mold 8. The melt flows uniformly through the cross section of outlet region 7 and is distributed therein and then into the mold cavity within the mold 8. The melt flows through outlet region 7 in an essentially laminar manner in uniform distribution over its cross section and at a speed that is essentially the same in all cross sectional regions. The melt leaves the immersion zone 9 of the nozzle in a cross section that is the same as within immersion zone 9. This cross section is closely correlated to the cross section of the mold cavity within the mold, and is the same thereas except for the wall thickness of the submerged zone 9 and the unavoidable gaps 13, 14. As a result, the melt does not have to flow over substantial distances within the mold cavity. Therefore, turbulence associated with any such flow pattern is avoided. If the flow of the melt requires throttling or interruption, then the respective closing and/or regulating device 15 is actuated.

The drawings illustrate the various embodiments of the nozzle 1 as being of a one-piece construction. This is done for the sake of simplification of presentation. However, the immersion nozzle of the present invention can be produced as multiple parts for construction reasons, and also for reasons relating to different parts of the nozzle being subjected to different operational stresses. FIGS. 4 and 6 schematically illustrate possible joint lines T between separate parts of such multi-part nozzle constructions.

If desired, chamber 3 can be heated to prevent molten metal from freezing therein. Chamber 3 can be heated, for example, by induction heating.

Although the present invention has been described and illustrated with respect to preferred features thereof, it is to be understood that various changes and modifications may be made to the specifically described and illustrated arrangements without departing from the scope of the present invention.

We claim:

1. In an assembly of a mold with a mold cavity having a long, thin transverse cross-sectional configuration, and an immersion nozzle for discharging material into said mold cavity and including an immersion zone to be immersed in material in said mold cavity, said nozzle having therethrough a discharge channel including an inlet region and an outlet region, the improvement comprising:

said discharge channel further including, between said inlet region and said outlet region and at a location in the vicinity of said immersion zone, a pool-forming chamber;

a portion of said outlet region of said discharge channel extending through said immersion zone being widened and having a configuration approximating said cross-sectional configuration of said mold cavity;

said outlet region having, from said chamber in a direction of material flow, a configuration approximately corresponding to said configuration through said immersion zone; and a device to regulate the flow of material through said discharge channel.

2. The improvement claimed in claim 1, wherein said inlet region has a length substantially greater than a length of said outlet region, and said location of said chamber is substantially closer to said immersion zone than to an inlet end of said nozzle.

3. The improvement claimed in claim 1, wherein the material is molten metal, and said nozzle comprises a refractory ceramic nozzle.

4. The improvement claimed in claim 1, wherein said mold comprises a thin slab mold.

5. The improvement claimed in claim 1, wherein said mold comprises a strip casting mold.

6. The improvement claimed in claim 1, wherein said inlet region has a configuration approximately the same as said outlet region.

7. The improvement claimed in claim 1, wherein said inlet region has a configuration approximately the same as said configuration through said immersion zone.

8. The improvement claimed in claim 1, wherein said inlet region has a generally round cross section.

9. The improvement claimed in claim 1, wherein said device is disposed in said inlet region.

10. The improvement claimed in claim 1, wherein said device is disposed in said outlet region.

11. The improvement claimed in claim 1, wherein said device comprises a roller-shaped rotor having a radial slot therethrough.

12. The improvement claimed in claim 1, wherein said device is disposed at said location of said chamber.

13. The improvement claimed in claim 12, wherein said device comprises a rotor having formed in a periphery thereof a recess defining said chamber.

14. The improvement claimed in claim 1, wherein said device comprises an electromagnetic flow regulator.

15. The improvement claimed in claim 1, wherein said inlet region empties into said chamber from above.

16. The improvement claimed in claim 15, wherein said chamber is formed with an overflow rim opening into said outlet region.

17. The improvement claimed in claim 16, wherein said chamber widens from a mouth of said inlet region in a direction toward said overflow rim.

18. The improvement claimed in claim 16, wherein said overflow rim has a length equal to a widened longer dimension of said outlet region.

19. The improvement claimed in claim 1, wherein said chamber is formed with an overflow rim opening into said outlet region.

20. The improvement claimed in claim 19, wherein said chamber widens from a mouth of said inlet region in a direction toward said overflow rim.

21. The improvement claimed in claim 19, wherein said overflow rim has a length equal to a widened longer dimension of said outlet region.

22. The improvement claimed in claim 1, wherein said inlet region and said outlet region have approximately equal transverse cross-sectional areas.

23. The improvement claimed in claim 1, wherein said immersion nozzle has a uniform and constant wall thickness throughout said immersion zone.

24. The improvement claimed in claim 23, wherein outer surfaces of said immersion zone are substantially equally spaced from respective confronting inner walls of said mold throughout the length of said immersion zone.

25. An immersion nozzle for discharging material into a mold cavity having a long, thin transverse cross-sectional configuration, said nozzle comprising:

an immersion zone to be inserted into a mold cavity and immersed in material therein;

a discharge channel extending through said nozzle, said discharge channel including an inlet region, an outlet region including a portion passing through said immersion zone, and a pool-forming chamber between said inlet region and said outlet region at a location in the vicinity of said immersion zone;

said portion of said outlet region of said discharge channel extending through said immersion zone being widened and having a configuration to approximate the cross-sectional configuration of the mold cavity;

said outlet region having, from said chamber in a direction of material flow, a configuration approximately corresponding to said configuration through said immersion zone; and a device to regulate the flow of material through said discharge channel.

26. The nozzle as claimed in claim 25, wherein said inlet region has a length substantially greater than a length of said outlet region, and said location of said chamber is substantially closer to said immersion zone than to an inlet end of said nozzle.

27. The nozzle as claimed in claim 25, wherein said inlet region has a configuration approximately the same as said outlet region.

28. The nozzle as claimed in claim 25, wherein said inlet region has a configuration approximately the same as said configuration through said immersion zone.

29. The nozzle as claimed in claim 25, wherein said inlet region has a generally round cross section.

30. The nozzle as claimed in claim 25, wherein said device is disposed in said inlet region.

31. The nozzle as claimed in claim 24, wherein said device is disposed in said outlet region.

32. The nozzle as claimed in claim 24, wherein said device comprises a roller-shaped rotor having a radial slot therethrough.

33. The nozzle as claimed in claim 24, wherein said device is disposed at said location of said chamber.

34. The nozzle as claimed in claim 33, wherein said device comprises a rotor having formed in a periphery thereof a recess defining said chamber.

35. The nozzle as claimed in claim 24, wherein said device comprises an electromagnetic flow regulator.

36. The nozzle as claimed in claim 24, wherein said inlet region empties into said chamber from above.

37. The nozzle as claimed in claim 36, wherein said chamber is formed with an overflow rim opening into said outlet region.

38. The nozzle as claimed in claim 37, wherein said chamber widens from a mouth of said inlet region in a direction toward said overflow rim.

39. The nozzle as claimed in claim 37, wherein said overflow rim has a length equal to a widened longer dimension of said outlet region.

40. The nozzle as claimed in claim 25, wherein said chamber is formed with an overflow rim opening into said outlet region.

41. The nozzle as claimed in claim 40, wherein said chamber widens from a mouth of said inlet region in a direction toward said overflow rim.

42. The nozzle as claimed in claim 40, wherein said overflow rim has a length equal to a widened longer dimension of said outlet region.

43. The nozzle as claimed in claim 25, wherein said inlet region and said outlet region have approximately equal transverse cross-sectional areas.

44. The nozzle as claimed in claim 25, having a uniform and constant wall thickness throughout said immersion zone.

45. The nozzle as claimed in claim 19, wherein said rim is formed by a smoothly curved surface defining a portion of said discharge channel that curves smoothly from said chamber to said outlet region.

46. The nozzle as claimed in claim 40, wherein said rim is formed by a smoothly curved surface defining a portion of said discharge channel that curves smoothly from said chamber to said outlet region.

* * * * *